US010252549B2

(12) United States Patent
Hachmann et al.

(10) Patent No.: US 10,252,549 B2
(45) Date of Patent: Apr. 9, 2019

(54) METHOD OF PRODUCING PRINTED PRODUCTS

(71) Applicants: HEIDELBERGER DRUCKMASCHINEN AG, Heidelberg (DE); FUJIFILM CORPORATION, Tokyo (JP)

(72) Inventors: Peter Hachmann, Weinheim-Hohensachsen (DE); Bernd Sitzmann, Sandhausen (DE); Yasuhito Oshima, Tokyo (JP); Jun Yamanobe, Tokyo (JP)

(73) Assignees: Heidelberger Druckmaschinen AG, Heidelberg (DE); FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/604,913

(22) Filed: May 25, 2017

(65) Prior Publication Data

US 2017/0341419 A1 Nov. 30, 2017

(30) Foreign Application Priority Data

May 25, 2016 (DE) ..... 10 2016 209 076

(51) Int. Cl.
*B41J 2/21* (2006.01)
*B41J 11/00* (2006.01)
*B41M 5/00* (2006.01)

(52) U.S. Cl.
CPC ..... *B41J 11/002* (2013.01); *B41J 2/2114* (2013.01); *B41J 11/0015* (2013.01); *B41M 5/0017* (2013.01)

(58) Field of Classification Search
CPC ..... C09D 11/36; C09D 11/40; C09D 11/30; C09D 11/38; C09D 11/322; C09D 11/328;
(Continued)

(56) References Cited

U.S. PATENT DOCUMENTS 8,628,184 B2 * 1/2014 Aoyama ..... B41J 11/002 347/100
8,708,479 B2 4/2014 Link
(Continued)

FOREIGN PATENT DOCUMENTS

DE 102010060409 A1 5/2012
WO 2014173763 A1 10/2014

*Primary Examiner* — Manish S Shah
(74) *Attorney, Agent, or Firm* — Laurence A. Greenberg; Werner H. Stemer; Ralph E. Locher

(57) ABSTRACT

A printed product is produced by applying at least one colored and water-containing ink to image regions on a printing material in a drop-on-demand process, applying a substantially colorless and water-containing liquid a) to non-image regions and/or b) to image regions that have little ink in a drop-on-demand process and drying the printing material. In this case, the printing material has a coating with at least one acid. After applying ink and applying the liquid, a water-containing further liquid is applied both to image regions and to non-image regions of the printing material. The first-mentioned liquid and/or the further liquid contains at least one substance for at least partly neutralizing the acid. The undesired formation of crease waves or curls and glossiness fluctuations between varnished image areas and varnished non-image areas is thus advantageously avoided.

14 Claims, 1 Drawing Sheet

(58) Field of Classification Search
CPC ..... C09D 11/101; C09D 11/005; C09D 11/54; C09D 11/52; B41J 2/01; B41J 2/211; B41J 2/1433; B41J 2/17; B41J 2/17593; B41J 2/2107; B41J 2/1755; B41J 2/2114; B41J 2/2117; B41J 11/0015; B41J 11/002; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41M 5/0011; B41M 5/0017; B41M 7/00; B41M 7/0072; B41M 5/52; B41M 5/5218
See application file for complete search history.

(56) References Cited

U.S. PATENT DOCUMENTS

| | | | | |
|---|---|---|---|---|
| 8,721,062 | B2 * | 5/2014 | Sano | B41J 3/407 347/100 |
| 2001/0020964 | A1 * | 9/2001 | Irihara | B41J 2/2114 347/43 |
| 2002/0077386 | A1 * | 6/2002 | Kurabayashi | B41M 5/0017 523/161 |
| 2004/0104986 | A1 * | 6/2004 | Nito | B41J 2/2107 347/96 |
| 2005/0243121 | A1 * | 11/2005 | Onishi | B41J 2/2114 347/21 |
| 2010/0053236 | A1 | 3/2010 | Doishi et al. | |
| 2012/0249668 | A1 * | 10/2012 | Denda | B41M 5/0023 347/20 |
| 2013/0286069 | A1 * | 10/2013 | Aoyama | B41J 2/21 347/9 |
| 2016/0251532 | A1 | 9/2016 | Yano et al. | |

* cited by examiner

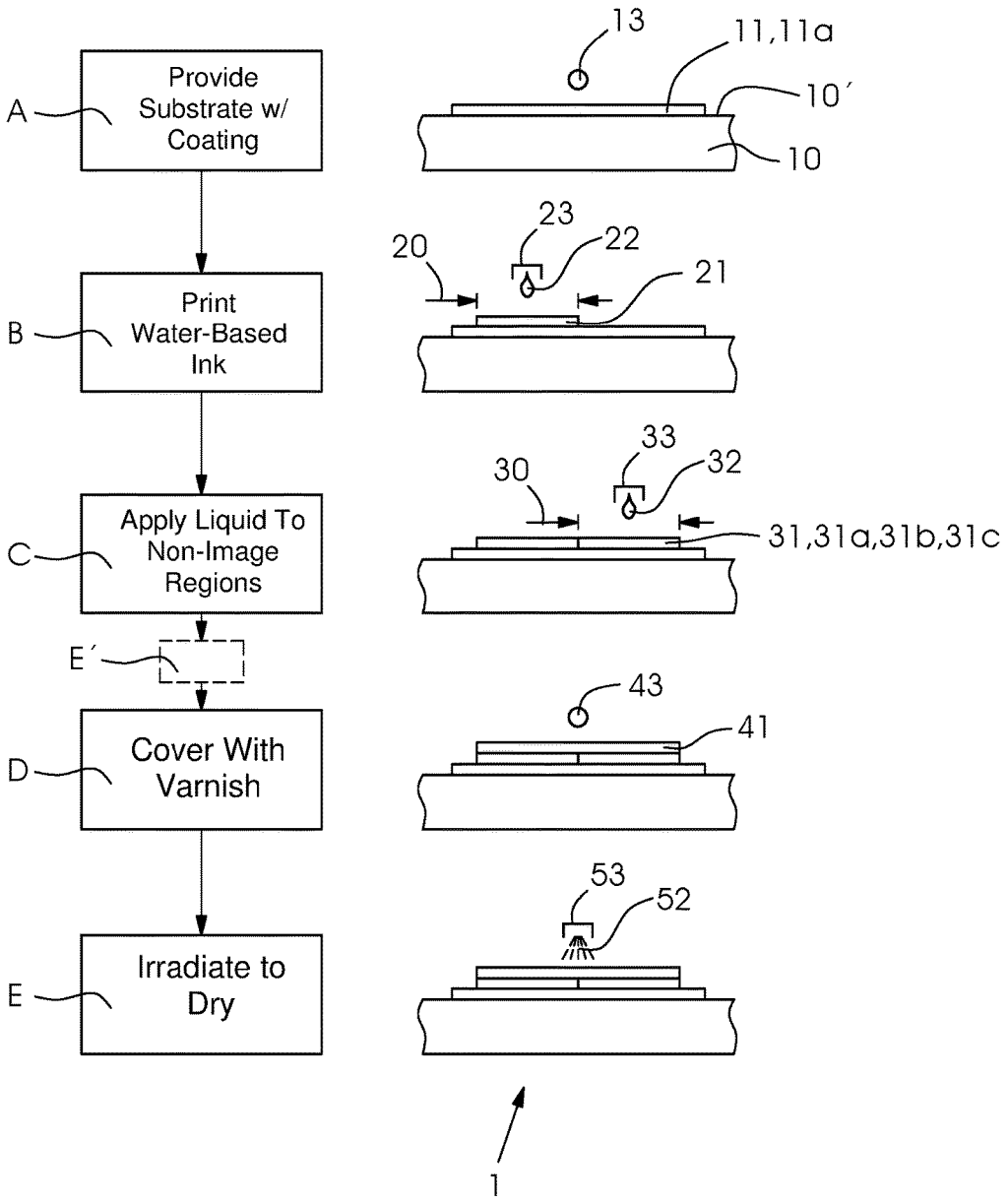
A
Provide Substrate w/ Coating
B
Print Water-Based Ink
C
Apply Liquid To Non-Image Regions
E´
D
Cover With Varnish
E
Irradiate to Dry
13
11,11a
10´
10
23
22
20
21
33
32
30
31,31a,31b,31c
43
41
53
52
1

METHOD OF PRODUCING PRINTED PRODUCTS

CROSS-REFERENCE TO RELATED APPLICATION

This application claims the priority, under 35 U.S.C. § 119, of German patent application DE 10 2016 209 076.3, filed May 25, 2016; the prior application is herewith incorporated by reference in its entirety.

THE NAMES OF THE PARTIES TO A JOINT RESEARCH AGREEMENT

This invention was made pursuant to a joint research agreement between Heidelberger Druckmaschinen AG and Fujifilm Corporation.

BACKGROUND OF THE INVENTION

Field of the Invention

The present invention relates to a method of producing printed products. At least one colored and water-containing ink is applied to image regions on a printing material in a drop-on-demand process and substantially colorless and water-containing liquid is then applied a) to non-image regions and/or b) to image regions that have little ink in a drop-on-demand process, before the printing material is dried.

The technical field of the invention is the field of the graphic arts industry, in particular the field of inkjet printing. In the known DoD (drop-on-demand) inkjet printing methods, a print head creates tiny ink droplets in accordance with the image to be printed and transfers these droplets onto a printing material without contact to create the printed image on the printing material. The printing substrate may be made of paper, cardboard, or plastic and may be sheet or web shaped.

U.S. Pat. No. 8,708,479 B2 and its counterpart published German patent application DE 10 2010 060 409 A1 disclose a method for reducing the formation of crease waves, or curling, in a printing material in a printer and a corresponding device for printing on a printing material. In the disclosed process, ink is applied to at least one printing region on the printing material and the moisture of the printing material is increased in at least one non-printed part of the printing material. This may be done by applying a transparent liquid. Thus in image regions, ink may be applied, and in non-image regions, a transparent liquid may be applied. A separate print head may be provided to apply the transparent liquid.

This prior art document presents a solution to the known problem that printing materials exhibit an undesirable formation of creases when uneven amounts of moisture are applied. An additional problem is, however, that printed products that are varnished after the printing process may have an uneven gloss: although the varnish is applied evenly, unprinted regions may be less glossy than printed regions.

US 2010/0053236 A1 discloses an ink printing method wherein a pre-coat containing an acid is initially applied to a substrate. Subsequently, a water-based ink is applied, whose droplets aggregate due to the acid and thus spread only to a limited extent. The ink print is subsequently dried.

In experiments on varnishing such ink prints that have been aggregated by an acid, it has been found that the aforementioned problem of an uneven gloss may occur and may have a considerable detrimental effect. Attempts have been made to solve this problem; the result is the invention described below.

SUMMARY OF THE INVENTION

It is accordingly an object of the invention to provide a method of producing printed materials which overcomes the above-mentioned and other disadvantages of the heretofore-known devices and methods of this general type and which provides for an improvement over the prior art and solves both the problem of wave-forming and the problem of uneven glossiness. Thus another object of the present invention is to provide a method for creating better printed products than methods of the prior art, i.e. printed products with a more homogeneous gloss.

With the foregoing and other objects in view there is provided, in accordance with the invention, a method of producing a printed product, the method comprising:

providing a printing material substrate with a coating containing an acid;

applying at least one colored and water-containing ink to image regions on said coating in a drop-on-demand process;

applying a substantially colorless and water-containing liquid in a drop-on-demand process to one or both of the following:

non-image regions on the coating; and/or image regions on the coating that carry only a small amount of ink;

applying a water-containing further liquid both to the image regions and to the non-image regions on the printing material; and wherein at least one of the water-containing liquid or the water-containing further liquid contains a substance for at least partly neutralizing the acid; and drying the printing material.

In accordance with the invention, a method for manufacturing printed products comprising the steps of applying at least one colored and water-containing ink to image regions on a printing material in a drop-on-demand process, applying an essentially colorless and water-containing liquid a) to non-image regions and/or b) to image regions that have little ink in a drop-on-demand process and drying the printing material is characterized in that the printing material has a coating comprising at least one acid, that, after applying ink and applying a liquid, a water-containing further liquid is applied both to image regions and to non-image regions of the printing material, and that the liquid and/or the further liquid contains at least one substance for at least partly neutralizing the acid.

Such a method of the invention solves the problems indicated above and advantageously allows printed products to be manufactured that exhibit neither the undesired waviness nor undesirable uneven glossiness.

An essential feature of the invention is that the liquid and/or the further liquid contain/s at least one substance that at least partly neutralizes the acid provided in the coating. This prevents the acid from reacting with the further liquid (e.g., a water-based varnish), and from modifying the glossiness properties thereof. Thus the application of the neutralizing substance preferably occurs in such a way that the neutralizing of the acid eliminates uneven gloss effects on the printing substrate or reduces them to a defined measure.

The neutralizing substance is preferably a substance that increases the pH value of the printing substrate and/or of the coating, preferably to approximately 5 or a value above 5.

In the context of the invention, image areas with "a small amount" of ink are understood to be image areas that have less than 100% area coverage, in particular less than 95% or 90% or 75% or 50% of area coverage, i.e. areas in which the white of the paper shines through.

In accordance with a preferred feature of the invention, the liquid is a colorless, in particular non-pigmented or colorant-free water-based ink that is substantially free of binding agents. If a liquid without pigments or colorants is used, the visual impression of the printed product to be manufactured is not altered in any discernible way. An additional advantage of using ink as the liquid is that the liquid may be applied to the printing material without difficulty by means of an inkjet print head. The ink may contain otherwise common additives such as surfactants, biocides, humectants, or defoaming agents. These additives and their volume in the ink may advantageously be used to adjust the applicability of the ink by means of a conventional print head and/or the ability to sufficiently wet the printing material for a good print result.

The term "substantially" as used herein is intended to denote a value or an amount that does not materially change the appearance or the function of the correspondingly modified feature.

Another preferred further development of the invention may be characterized in that the concentration of the neutralizing substance substantially corresponds to a defined concentration value and that the defined concentration value is a function of the concentration of the acid or of the mixture of multiple acids in the coating. The concentration of the neutralizing substance, in particular of the neutralizing acid groups in the neutralizing substance, may preferably selected to be as high as the concentration of the acid or neutralized acid groups in the coating.

A preferred further development of the invention may be characterized in that the defined concentration value is selected in a way to achieve an essentially complete neutralization of the acid. The concentration of the protons in the coating, which may be calculated from the pH value of the coating, may preferably be selected to be as high as the concentration of the neutralizing substance, in particular the neutralizing acid group in the neutralizing substance and vice versa.

The amount to be applied may be calculated by adding up the relevant regions of the printing material that are to be coated, i.e. the ones with paper white.

A preferred further development of the invention may be characterized in that the drying effect is achieved by applying IR radiation to the printing material and in that the liquid contains an IR absorber as a second substance. The fact that in accordance with the invention, the water-containing liquid is applied in addition to the water-containing ink increases the amount of water and thus the demands on the drying process. Thus it is advantageous to improve the drying properties of the liquid at the same time. This may advantageously be achieved by the use of an IR absorber. This may advantageously prevent printed products from drying insufficiently and sticking together, for instance in a delivery stack.

A preferred further development of the invention may be characterized in that the liquid contains an optical whitener as a third substance. This measure is advantageous if a decreasing brightness value would otherwise have to be expected at least in the regions to which the liquid is applied due to the application of the acidic coating and/or due to the application of the liquid.

A preferred further development of the invention may be characterized in that in a case a) the average of the amount of liquid applied per unit area calculated for the printing material essentially corresponds to the average of the amount of ink applied per unit area calculated for the printing material. This measure may advantageously achieve that on average, the dampening of the printing material by the water contained in the ink and by the water contained in the liquid is approximately even over the entire treated surface of the printing material. This measure may likewise prevent the undesired formation of waves.

In accordance with an additional feature of the invention, the substance is a base. In a preferred further development of the invention the substance is an amine, in particular a water-soluble amine, 2-Amino-2-methyl-1-propanol, an alkali hydroxide, in particular NaOH or KOH.

In accordance with a concomitant feature of the invention the further liquid is colorless, in particular a colorless and water-based varnish.

Other features which are considered as characteristic for the invention are set forth in the appended claims.

Although the invention is illustrated and described herein as embodied in novel printing method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE of the drawing contains a flow chart of a preferred exemplary embodiment of the method of the invention and a side-by-side illustration of device-related measures for implementing the method.

DETAILED DESCRIPTION OF THE INVENTION

Referring now to the FIGURE of the drawing in detail there is shown a schematic illustration of steps A to E and E', respectively, of a preferred embodiment of the method of the invention, in the form of a flow chart. Next to every step, the FIGURE also schematically shows the respective device-related measures that may be taken and how the printed product may successively be produced.

Step A is to provide a printing material substrate 10 having a surface 10'. The printing substrate may be a sheet or a web. The printing substrate may be made of paper, cardboard, or plastic. A coating 11 comprising an acid 11*a* is applied to the printing substrate. The coating may for instance be applied by means of a roller 13. As an alternative to the illustrated step A, a printing substrate may be provided that has already been coated with an acid. The expression "providing a substrate with a coating," therefore, may relate to either alternative.

In step B, a water-based ink 21 is printed onto the printing material 10 or rather the surface 10' thereof, i.e. an ink layer 21 is created. The image region may for instance represent a pattern, image, or text. To create the ink layer 21, ink droplets 22 are transferred to the printing material, i.e. the surface thereof, in a contact-free way by way of a print head 23. In this process, the print head is controlled in a known way, making use of the print data required for the image. In general, this process requires a relative movement between the print head and the printing material to be generated. It is possible to print more than one ink, e.g. four (CMYK) or more than four (CMYK plus spot color/s). The ink may contain pigments or colorants to give it color.

In step C, a liquid 31 is applied to a non-image region and/or a liquid layer 31 is created. The liquid contains at least one substance 31*a* for neutralizing the acid 11*a*, preferably a base such as NaOH or KOH. In addition, the liquid may contain a second substance 31*b*, preferably an IR absorber. In addition, the liquid may contain a third substance 31*c*, preferably an optical whitener. In the non-image areas of the surface 10' of the printing substrate 10, the acid 11*a* is neutralized by the application of the liquid 31 and the neutralizing substance 31*a* contained therein. The application of the liquid 31 is achieved by transferring liquid droplets 32 to the surface of the printing substrate by means of a further print head 33 in a contact-free way. The use of a print head makes it easy to control the amount of liquid that is applied.

In step D, a further liquid 41 is applied to the printing material 10, i.e. the surface 10' thereof, and/or a further liquid layer 41 is created. The application may for instance be achieved by means of a roller 43. The further liquid may be a colorless or transparent water-based varnish. Such a layer of varnish may essentially cover the entire surface of the printing material, i.e. both the image areas 20 and the non-image areas 30. In accordance with the invention, the neutralized acid has no (chemical) effect or only a minor (chemical) effect on the varnish layer, which thus globally (over the entire printing material, i.e. in image regions and non-image regions) exhibits a substantially homogeneous glossiness.

In step E, the printing material 10 or rather the surface 10' thereof and in particular the ink 21 and liquids 31 and 41 applied thereto are dried, preferably thermally. For this purpose, IR radiation 52 may be generated and directed towards the printing material surface by means of an IR drier 53, e.g. an LED drier or an LED laser drier. This process may likewise require a relative movement between the drier and the printing material to be carried out. The intensity of the radiation may be controlled.

An alternative to step E is to carry out a drying step E', which preferably occurs after step C and before step D. Another alternative is to carry out both drying steps E and E'.

The following is a summary list of reference numerals and the corresponding structure used in the above description of the invention:

1 printed product
10 printing material
10' surface
11 coating
11*a* acid
13 roller
20 image region
21 ink/ink layer
22 ink drops
23 print head
30 non-image region
31 liquid/liquid layer
31*a* neutralizing substance/base
31*b* second substance/IR absorber
31*c* third substance/optical whitener
32 drops of liquid
33 further print head
41 further liquids/further liquid layer/varnish layer
43 roller
52 IR radiation
53 IR drier
A providing a printing substrate with a coating
B applying ink
C applying liquid
C applying further liquid/varnish
E, E' IR drying

The invention claimed is:

1. A method of producing a printed product, the method comprising:
- providing a printing material substrate with a coating containing an acid;
- applying at least one colored and water-containing ink to image regions on said coating in a drop-on-demand process;
- applying a substantially colorless and water-containing liquid in a drop-on-demand process to one or both of the following:
  - a) non-image regions on the coating; and/or
  - b) image regions on the coating that carry only a small amount of ink;
- applying a water-containing further liquid both to the image regions and to the non-image regions on the printing material; and
- wherein at least one of the water-containing liquid or the water-containing further liquid contains a substance for at least partly neutralizing the acid; and
- drying the printing material.

2. The method according to claim 1, wherein the water-containing liquid is a colorless, water-based ink that is substantially free of binding agents.

3. The method according to claim 1, wherein the water-containing liquid is a non-pigmented or colorant-free liquid.

4. The method according to claim 1, wherein a concentration of the substance for at least partly neutralizing the acid substantially corresponds to a defined concentration value and the defined concentration value depends on a concentration of the acid in the coating.

5. The method according to claim 4, which comprises selecting the defined concentration value so as to achieve a substantially complete neutralization of the acid.

6. The method according to claim 1, wherein the drying step comprises irradiating the printing material and wherein the water-containing liquid contains an IR absorber.

7. The method according to claim 6, wherein the water-containing liquid contains an optical whitener.

8. The method according to claim 1, wherein the water-containing liquid is applied to a) the non-image regions on the coating and an average of an amount of liquid applied per unit area on the printing material is substantially equal to an average amount of ink applied per unit area on the printing material.

9. The method according to claim 1, wherein the substance for at least partly neutralizing the acid is a base.

10. The method according to claim 9, wherein the substance for at least partly neutralizing the acid is an amine, 2-Amino-2-methyl-1-propanol, and an alkali hydroxide.

11. The method according to claim 10, wherein the amine is a water-soluble amine.

12. The method according to claim 10, wherein the alkali hydroxide is NaOH or KOH.

13. The method according to claim 1, wherein the water-containing further liquid is a colorless liquid.

14. The method according to claim 13, wherein the water-containing further liquid is a water-based varnish.

* * * * *